US010440485B2

(12) United States Patent
Kral et al.

(10) Patent No.: US 10,440,485 B2
(45) Date of Patent: Oct. 8, 2019

(54) HEARING AID AND EARPIECE

(71) Applicant: SIVANTOS PTE. LTD., Singapore (SG)

(72) Inventors: Holger Kral, Fuerth (DE); Stefanie Beyfuss, Erlangen (DE); Bjoern Freels, Erlangen (DE)

(73) Assignee: Sivantos Pte. Ltd., Singapore (SG)

( * ) Notice: Subject to any disclaimer, the term of this patent is extended or adjusted under 35 U.S.C. 154(b) by 0 days.

(21) Appl. No.: 15/822,650

(22) Filed: Nov. 27, 2017

(65) Prior Publication Data

US 2018/0084355 A1 Mar. 22, 2018

Related U.S. Application Data

(63) Continuation of application No. PCT/EP2016/053595, filed on Feb. 19, 2016.

(30) Foreign Application Priority Data

May 27, 2015 (DE) ..... 10 2015 209 741

(51) Int. Cl.

| | |
|---|---|
| ***H04R 25/00*** | (2006.01) |
| ***H04R 1/10*** | (2006.01) |
| ***H04R 25/02*** | (2006.01) |

(52) U.S. Cl.

CPC ..... *H04R 25/65* (2013.01); *H04R 1/1016* (2013.01); *H04R 1/1066* (2013.01); *H04R 25/02* (2013.01); *H04R 25/40* (2013.01); *H04R 25/60* (2013.01); *H04R 25/652* (2013.01); *H04R 25/656* (2013.01); *H04R 25/658* (2013.01); *H04R 2201/10* (2013.01)

(58) Field of Classification Search

CPC .... H04R 25/65; H04R 25/608; H04R 25/652; H04R 25/656; H04R 25/658; H04R 1/1016; H04R 1/1066; H04R 2201/10

See application file for complete search history.

(56) References Cited

U.S. PATENT DOCUMENTS

| | | | | |
|---|---|---|---|---|
| 2,521,414 A | | 9/1950 | Schier | |
| 3,080,011 A | * | 3/1963 | Henderson | H04R 25/656 128/868 |
| 3,732,382 A | * | 5/1973 | DeWitt | H04R 25/656 181/130 |

(Continued)

FOREIGN PATENT DOCUMENTS

| | | | |
|---|---|---|---|
| DE | 19504478 | A1 | 8/1996 |
| WO | 2004010734 | A1 | 1/2004 |

*Primary Examiner* — Joshua Kaufman

(74) *Attorney, Agent, or Firm* — Laurence A. Greenberg; Werner H. Stemer; Ralph E. Locher

(57) ABSTRACT

A hearing aid, in particular a BTE hearing aid, includes an ear insert having an earpiece and an attachment part being linked to a receiver. The earpiece includes an elongate adapter and a plurality of shields. The adapter is mounted on the attachment part and extends in a longitudinal direction. The earpiece is in a modular form and the at least one shield is exchangeably fitted onto the adapter. The adapter has a head with a rear abutment contour against which at least one of the shields abuts. In this way, the earpiece is particularly variably and flexibly configurable. A corresponding earpiece is also provided.

17 Claims, 2 Drawing Sheets

(56) References Cited

U.S. PATENT DOCUMENTS 3,813,499 A * 5/1974 Vignini ..... H04R 25/60 381/330
4,381,830 A * 5/1983 Jelonek ..... H04R 25/48 181/129
4,977,976 A * 12/1990 Major ..... H04R 25/48 181/130
5,201,007 A 4/1993 Ward et al.
5,488,205 A * 1/1996 Major ..... H04R 25/652 181/129
5,654,530 A * 8/1997 Sauer ..... H04R 25/652 181/130
5,701,348 A 12/1997 Shennib et al.
5,975,235 A * 11/1999 Schlaegel ..... H04R 25/48 181/129
5,979,589 A * 11/1999 Aceti ..... A61B 5/6817 181/135
6,148,821 A * 11/2000 Falco ..... A61F 11/08 128/864
6,241,041 B1 * 6/2001 Leight ..... A61F 11/08 181/135
6,695,093 B1 * 2/2004 Falco ..... A61F 11/08 181/130
7,027,608 B2 * 4/2006 Fretz ..... H04R 25/65 381/330
RE40,696 E * 4/2009 Iseberg ..... H04R 1/1016 181/130
7,522,743 B2 * 4/2009 Dobras ..... H04R 1/1058 181/129
7,627,131 B2 * 12/2009 Nielsen ..... H04R 25/652 181/135
8,083,022 B2 * 12/2011 Gommel ..... H04R 25/652 181/135
8,474,571 B1 * 7/2013 Bilan ..... A61B 7/02 181/129
8,477,978 B2 * 7/2013 Caldarola ..... H04R 25/02 181/130
8,488,821 B2 * 7/2013 Kral ..... H04R 25/65 381/312
8,498,436 B2 * 7/2013 Cheng ..... H04R 25/60 381/322
8,625,834 B2 * 1/2014 Smith ..... H04M 1/05 381/380
8,718,306 B2 * 5/2014 Gommel ..... H04R 25/60 381/322
9,204,228 B2 * 12/2015 Chan ..... H04R 25/60
9,253,580 B2 * 2/2016 Parsi ..... H04R 25/604
9,392,383 B2 * 7/2016 Nielsen ..... H04R 25/65
10,097,936 B2 * 10/2018 Barrett ..... H04R 1/1016
10,154,352 B2 * 12/2018 Perkins ..... H04R 25/405
10,284,977 B2 * 5/2019 Shen ..... H04R 25/652
2005/0147267 A1 * 7/2005 Gudmundsen ..... H01M 2/1022 381/328
2005/0238192 A1 * 10/2005 Ford ..... H04R 25/654 381/322
2007/0202735 A1 * 8/2007 Hanks ..... H01R 4/5033 439/427
2008/0002848 A1 * 1/2008 Heerlein ..... H04R 25/604 381/328
2008/0187159 A1 * 8/2008 Blanchard ..... A61F 11/08 381/328
2009/0052710 A1 * 2/2009 Smith ..... H04R 25/656 381/328
2009/0080680 A1 * 3/2009 Beyfuss ..... H04R 25/65 381/324
2010/0027825 A1 * 2/2010 Fickweiler ..... H04R 25/60 381/330
2011/0188689 A1 * 8/2011 Beck ..... H04R 1/1066 381/328
2011/0194716 A1 * 8/2011 Gommel ..... H04R 1/1066 381/328
2011/0211716 A1 * 9/2011 Cheng ..... H04R 25/60 381/322
2012/0281865 A1 * 11/2012 Caldarola ..... H04R 5/02 381/328
2013/0170692 A1 * 7/2013 Kaneko ..... H04R 1/1016 381/380
2015/0049896 A1 * 2/2015 Blanchard ..... H04R 1/1016 381/380
2016/0066110 A1 * 3/2016 Shennib ..... H04R 25/652 381/328
2018/0084355 A1 * 3/2018 Kral ..... H04R 1/1016

* cited by examiner

HEARING AID AND EARPIECE

CROSS-REFERENCE TO RELATED APPLICATION

This application is a continuation, under 35 U.S.C. § 120, of copending International Application PCT/EP2016/053595, filed Feb. 19, 2016, which designated the United States; this application also claims the priority, under 35 U.S.C. § 119, of German Patent Application DE 10 2015 209 741.2, filed May 27, 2015; the prior applications are herewith incorporated by reference in their entirety.

BACKGROUND OF THE INVENTION

Field of the Invention

The invention relates to a hearing aid including an ear insert having an earpiece and an attachment part which is connected to a receiver, the earpiece is composed of an elongate adapter and a plurality of shields and the adapter is mounted on the attachment part and extends in a longitudinal direction. The invention further relates to an earpiece.

A corresponding hearing aid is shown, for example, in International Publication WO 2004/010734 A1. There, an elongate tube is attached to a CIC hearing aid, and one or more shields are mounted as an acoustic seal on the tube. In the inserted state, the shields bear on the inner wall of the auditory canal and seal the latter. An interspace is formed between the shields in order to reduce feedback and occlusion effects. In a variant with only one shield, the housing of the CIC device itself, sitting in the auditory canal, forms a seal.

A hearing aid is understood in particular as a device for amplifying sound. For that purpose, a hearing aid has a plurality of microphones, suitable electronics and a receiver, i.e. a loudspeaker. Various hearing aids are differentiated in terms of the positioning of the receiver, on one hand, and of the remaining electronics in a suitable housing on or in the ear of the user, on the other hand.

In a so-called BTE device, i.e. a behind-the-ear device, the housing is worn behind the ear. The receiver is either disposed in the housing, with the sound being carried into the auditory canal by using a sound tube, or the receiver is constructed as an external receiver, attached to the hearing aid through a cable and inserted into the auditory canal. The latter variant is also referred to as an RIC, i.e. receiver in canal.

Alternatively, the housing is not worn behind the ear, but instead in the ear. Such a hearing aid is then referred to as an ITE (in-the-ear) device or CIC (completely-in-canal) device, depending on whether, in addition to the receiver, the housing also sits with its other components partially (ITE) or completely (CIC) in the auditory canal.

The earpiece usually has an outer contour which serves to provide a seal against the auditory canal. Particularly in BTE devices, the earpiece is often constructed as a so-called shield, also referred to as a dome. The shield is secured on an attachment part, which in turn is connected to the receiver. In an RIC device, the attachment part is, for example, an attachment stub of the receiver. In the case of a receiver worn outside the auditory canal, the attachment part is, for example, a sound tube which is optionally equipped with a suitable connection part for connection to the shield. In principle, any connection devices suitable for connecting the earpiece to the receiver in an RIC device are also suitable for connecting an earpiece to a sound tube of a BTE device with a receiver.

Since the auditory canal of a user is shaped individually in each case, the earpiece is usually exchangeable, and earpieces are available in a wide range of sizes and shapes from which a suitable earpiece is chosen for a particular user. However, the disadvantage is that a large number of different earpieces then have to be kept in stock in order to be able to provide each user with an earpiece that gives the best possible fit and the greatest comfort.

SUMMARY OF THE INVENTION

It is accordingly an object of the invention to provide a hearing aid and an earpiece, which overcome the hereinafore-mentioned disadvantages of the heretofore-known devices of this general type and in which the earpiece can be easily adapted to the individual requirements of a user.

With the foregoing and other objects in view there is provided, in accordance with the invention, a hearing aid, in particular a BTE hearing aid, comprising an ear insert having a receiver, an earpiece and an attachment part connected to the receiver, the earpiece having a modular construction and including an elongate adapter being mounted on the attachment part and extending in a longitudinal direction, the adapter including only one central portion and a head having a rear abutment contour, the head adjoining the central portion in the longitudinal direction, and the central portion being tapered relative to the head, and the earpiece having a plurality of shields configured to be exchangeably fitted onto the central portion with at least one of the shields bearing against the rear abutment contour.

With the objects of the invention in view, there is also provided, in a hearing aid according to the invention, an earpiece having a modular construction, the earpiece comprising an elongate adapter constructed for connection to the attachment part of the hearing aid, the adapter extending in a longitudinal direction, and the adapter having a head with a rear abutment contour, and a plurality of shields, at least one of the shields being exchangeably fitted onto the adapter and at least one of the shields bearing against the rear abutment contour.

Advantageous embodiments, developments and variants are the subject matter of the dependent claims. The statements made regarding the hearing aid also apply by analogy to the earpiece, and vice versa.

The hearing aid is constructed in particular as a BTE hearing aid, i.e. as a hearing aid with a housing which is worn behind the ear by the user. In order to output sound, a BTE hearing aid of this kind has a receiver which is either accommodated in the housing or is worn as an external receiver in the ear. The hearing aid moreover has an ear insert, which has an earpiece, and also an attachment part which is connected to a receiver. The earpiece is composed of an elongate adapter and of a plurality of shields. The adapter extends in a longitudinal direction and is mounted on the attachment part and is generally constructed for connection to the attachment part of the hearing aid. The earpiece itself has a modular configuration, and the shield or each shield is fitted exchangeably onto the adapter, wherein the adapter has a head with a rear abutment contour against which at least one shield bears.

An underlying concept of the invention is, in particular, to construct the ear insert not in the usual way as a one-part shield, but instead as a modular ear insert which is composed individually of various individual parts. The adapter in this case serves as the base element to which further elements can be added in order to obtain a defined shape and/or functionality of the earpiece. One or more shields are then fitted onto the adapter according to requirements. The adapter itself is advantageously a standard component and can be used in each ear insert irrespective of the required shape or function. This is achieved in particular by the elongate structure of the adapter, i.e. the latter is longer than it is wide. On one hand, several shields can also be mounted one behind another on the adapter according to requirements and, on the other hand, the adapter is also sufficiently narrow to be able to be inserted into any auditory canal, in particular without causing a sealing action, i.e. closing the auditory canal.

Thus, an advantage of the invention is in particular that the ear insert can be individually tailored in a particularly simple manner, since all that has to be done is to fit one or more suitable shields onto the adapter. Advantageously, the shields themselves simply have to be pushed or plugged onto the adapter and therefore require no special coupling element for connection to the attachment part. The shields thus have a particularly simple structure overall. A further advantage is in particular that, upon being exchanged, the ear insert does not have to be completely replaced, and instead the adapter is reusable, with only the shield being exchanged. In this way, material is saved overall.

The abutment contour forms a limit stop in the longitudinal direction for the shield mounted on the adapter. In this way, when the ear insert is withdrawn from the auditory canal, the shield is held securely against being pulled off. For this purpose, the abutment contour is constructed as an abutment face that extends transversely and preferably perpendicularly with respect to the longitudinal direction. If several shields are mounted on the adapter, then the shields are disposed one behind another in the longitudinal direction. In particular, the shields are disposed directly one behind another, i.e. a shield serves as an abutment contour or limit stop for the succeeding shield. Only the shield at the front bears directly against the abutment contour of the head.

The earpiece and in particular the entire ear insert are preferably rotationally symmetrical with respect to the longitudinal direction. In the cross section perpendicular to the longitudinal direction, this results in a generally round cross-sectional contour for the adapter and preferably also for the shield or each shield. A shield is then ring-shaped, with a central opening in which the adapter sits. The opening preferably has a hollow cylindrical shape. The adapter and the shield are then in particular disposed concentrically.

The rear abutment contour is expediently ring-shaped so that, when the earpiece is pulled out, there is a particularly uniform and planar load and, as a result, particularly reliable handling. Particularly in the case of the rotationally symmetrical structure, the abutment contour stems from the fact that the head has an external diameter which is greater than an internal diameter, i.e. opening diameter of the opening of the shield. The shield then abuts frontally, i.e. with its front end, against the abutment contour, with "frontally" being understood in particular as in the direction of the head, i.e. in the inserted state into the auditory canal. The abutment contour is accordingly oriented to the rear.

Configurations that are not rotationally symmetrical are also conceivable in principle.

The attachment piece serves for joining the earpiece to the rest of the hearing aid and especially for joining to the receiver. Accordingly, the attachment piece has a sound channel through which sound is transported from the receiver to the ear insert. In a hearing aid in which the receiver is worn in the ear, the attachment piece is, for example, an attachment stub on the receiver. The attachment stub is, for example, a structure on the receiver and is formed in one piece therewith. In a hearing aid in which the receiver is worn outside the auditory canal, the attachment piece is, for example, a sound tube or an end piece which is fitted, in particular secured, on the end of the sound tube. Overall, the attachment piece forms a coupling element for joining the earpiece. The attachment piece and the earpiece together form the ear insert, which is in particular worn completely in the ear.

The shield is usually an elastic part which, during insertion, adapts to the shape of the auditory canal. Typically, the shield is more or less dome-shaped or bell-shaped and is therefore also referred to as a dome.

Apart from the opening for fitting it onto the adapter, the shield in a first variant has a closed construction. Alternatively, the shield has a plurality of vents or pressure compensation holes. For example, the vents or holes are distributed in the circumferential direction about the longitudinal direction and therefore also about the adapter. Generally, there are many structural options for the shield, depending on which specific function the shield is intended to perform. A particular advantage of the invention is in particular that different shields can be combined in a modular concept and, as a result, different functions can also be combined.

In order to permit individual adaptation to the auditory canal of the user, the shield or each shield is expediently exchangeable and chosen from a set of shields. In this way, the earpiece as a whole is optimally adapted to the individually shaped auditory canal of the user. For example, a shield is chosen for its external diameter, or a choice is made between an open shield and a closed shield or between different material thicknesses or elasticities. Alternatively or in addition, a choice is made between different materials; this is advantageous in particular against the background of individual material incompatibilities. Since all shields are exchangeable, the adapter can in principle also be used alone, i.e. without shields.

In a preferred embodiment, the head is adjoined in the longitudinal direction by a central portion, which is tapered in relation to the head and onto which the shield or each shield is fitted. In other words, the central portion has a smaller external diameter than the head. In this way, a suitable abutment contour is formed in a particularly simple way, namely by formation of a shoulder or step in the transition region from the head to the central portion. The central portion abuts the rear face of the head, i.e., proceeding from the head, out of the auditory canal.

The shield or each shield preferably has an opening, with the opening diameter corresponding at most to an external diameter of the central portion. This ensures that the shield is also held back by the abutment contour and does not slip over the latter during withdrawal. Moreover, this in particular ensures that ear wax is effectively held back and cannot escape through a gap between the shield and the adapter. The external diameter of the central portion is measured near the abutment contour and is in particular a minimum external diameter.

An embodiment is particularly preferred in which the opening diameter is smaller than the external diameter of the central portion, in such a way that the shield is secured particularly safely on the adapter in the manner of an interference fit. It is particularly expedient in this case for the shield to be produced from an elastic material in such a way that the opening initially widens suitably, when being pushed over the head, and finally engages form-lockingly around the central portion.

The adapter expediently has an end portion, which is secured on the attachment part. In this way, the adapter and the attachment part are connected to each other in a particularly robust manner. For this purpose, the end portion has a suitable coupling part which is connected to an in particular complementary coupling part of the attachment part. For example, the coupling parts form a plug connection with a plug and a socket. The plug is, for example, a so-called "honey dipper" attachment, i.e. a cylindrical stub with a lateral surface on which a plurality of annular extensions spaced apart from each other in the longitudinal direction are formed about the circumference. The socket then has a complementary shape. Alternatively, a spherical attachment is also suitable, for example, which then sits in a socket having a suitable spherical seat. Generally, the attachment part and the adapter are suitably connected to each other with form-locking engagement and preferably also in a manner secure against separation.

The rear face of the end portion is adjoined by the central portion, in such a way that the central portion is disposed in the longitudinal direction between the head and the end portion and connects these two portions to each other. The end portion advantageously has a greater external diameter than the central portion, in such a way that the shield is also secured against accidentally slipping off over the end portion. However, it is not absolutely necessary for a step with an abutment contour to also be formed. Instead, the external diameter of the adapter increases continuously in a transition region in the longitudinal direction from the central portion to the end portion.

In a particularly preferred embodiment, the adapter is formed in one piece, i.e. formed from one part and in particular produced from only one material. Such an adapter is particularly simple and cost-effective.

A particularly advantageous embodiment is one in which the adapter and the shield or each shield are produced from the same material. Thus, the entire earpiece is produced from a single material. In principle, however, the use of different materials for the adapter and the shield is also suitable. A suitable material is, for example, silicone and generally an elastic material.

In order to ensure good transmission of sound from the receiver into the ear, the adapter is suitably tubular and has a sound channel which leads into a sound outlet opening in the head. A continuous cavity for sound transmission is thus formed starting at the receiver and extending as far as the sound outlet opening. The sound channel usually has a round cross section and extends along the entire length of the adapter. The sound channel extends in particular in the longitudinal direction and is preferably disposed centrally. The term tubular in this case includes not just round cross sections but also cross sections deviating from the latter, in particular oval cross sections.

In one suitable embodiment, the head has an external diameter in the range of 2 mm to 5 mm. This ensures that the head is sufficiently narrow and is insertable without difficulty into every individually shaped auditory canal, while still having a sufficiently wide abutment contour. The external diameter is measured in this case at the widest part of the head and is therefore a maximum external diameter. Measured in the radial direction, i.e. in the cross section perpendicular to the longitudinal direction, the abutment contour preferably has a width in the range of 20% to 50% of the external diameter of the head.

Due to the stepped configuration, the external diameter of the central portion at the front end, i.e. near the head, corresponds in particular to the difference from the external diameter of the head and the width of the abutment contour. In the embodiment with an end portion having a greater external diameter than the central portion, the external diameter of the end portion preferably corresponds to the external diameter of the head. The sound channel expediently has an internal diameter in the range of 0.5 mm to 1 mm. The wall thicknesses of the various portions of the adapter are then obtained accordingly.

In a preferred embodiment, the adapter is at least 4 mm and at most 12 mm long, preferably at most 8 mm long. This ensures that the adapter is long enough to be able to receive several shields if necessary, but at the same time also sufficiently short to be comfortably insertable into the usually curved auditory canal.

In order in particular to ensure that insertion is as easy and as comfortable as possible, the head is rounded at the front end. This also makes it much easier for shields to be plugged on at the front end. Proceeding from the abutment contour, the head tapers in the longitudinal direction as far as the front end, i.e. toward the sound outlet opening. In the rotationally symmetrical configuration, the head is then hemispherical, bell-shaped or dome-shaped, for example. Any sharp edges are expediently avoided, in such a way that the head as a whole has a round and in particular also a smooth outer surface.

Other features which are considered as characteristic for the invention are set forth in the appended claims.

Although the invention is illustrated and described herein as embodied in a hearing aid and an earpiece, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
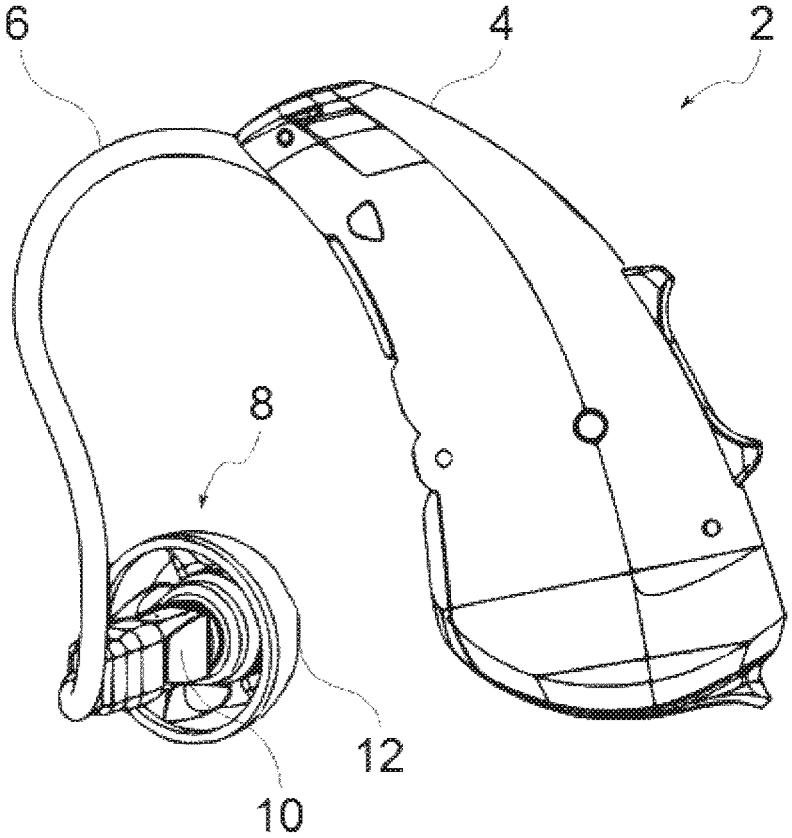
FIG. 1 is a diagrammatic, perspective view of a BTE hearing aid.

Referring now to the figures of the drawings in detail and first, particularly, to FIG. 1 thereof, there is seen a hearing aid 2, which in this case is a BTE hearing aid. The hearing aid 2 has a housing 4, which is worn behind the ear by the user. The housing 4 accommodates, for example, microphones, electronics and a battery (which are not shown). A supply line 6 is mounted on the front of the housing 4, is guided over the ear and connects the housing 4 to an ear insert 8, which is inserted into the ear. The BTE device shown in FIG. 1 is constructed as an RIC device, i.e. the hearing aid 2 has a receiver 10 which is pushed into the ear. In FIG. 1, the receiver 10 is thus a part of the ear insert 8.

In an alternative embodiment (not shown), the receiver 10 is accommodated in the housing 4, and the supply line 6 is then configured as a sound tube.

It will also be seen from FIG. 1 that the ear insert has a shield 12 which, in the inserted state, bears against the inner wall of the auditory canal and thus seals the auditory canal. For this purpose, the shield 12 is produced from an elastic material and is dome-shaped or bell-shaped with a curved outer surface.

Figure 2:
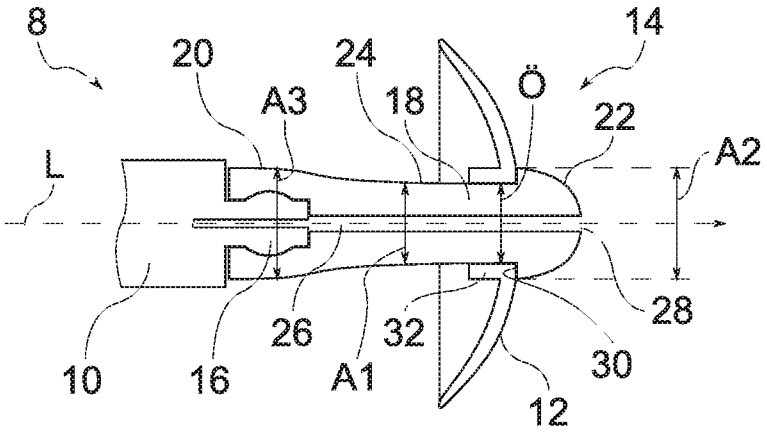
FIG. 2 is a longitudinal-sectional view of an ear insert with an attachment piece and an earpiece.

FIG. 2 shows an embodiment variant of an ear insert 8 in a cross-sectional view. The ear insert 8 in this case is formed by a receiver 10 and an earpiece 14, which is connected to the receiver 10 through an attachment part 16. In the illustrative embodiment shown, the attachment part 16 is a part of the receiver 10, namely a front-end stub which at the same time forms a coupling element or a plug connector, through the use of which the receiver 10 is secured on the earpiece 14.

As can be seen clearly from FIG. 2, the earpiece 14 has a modular configuration, i.e. a multi-part configuration, specifically a two-part configuration in the variant shown. An important component of the earpiece 14 is an elongate adapter 18, which extends in a longitudinal direction L and which is constructed for connection to the attachment piece 16. For this purpose, the adapter 18 in this case has an end portion 20 which forms a plug connection matching the attachment part 16, i.e. in this case a socket. At the front end, the adapter 18 has a head 22. The head 22 is connected to the end portion 20 through a central portion 24.

The adapter 18, as shown in FIG. 2, is preferably formed in one piece, i.e. it does not itself have a multi-part configuration. The sound generated by the receiver 10 is carried through a sound channel 26 formed inside the adapter 18. The adapter 18 as a whole thus has a tubular shape. The sound channel 26 runs centrally all the way through the adapter 18 as far as the head 22, where the sound channel 26 leads into a sound outlet opening 28. In the inserted state, the sound outlet opening 28 is directed into the interior of the auditory canal.

A shield 12 is fitted onto the central portion 24. This shield 12 is pushed forward as far as the head 22 and abuts there against an abutment contour 30, which is formed on the rear face of the head 22 by a step-like transition from the head 22 to the central portion 24. For this purpose, the central portion 24, at least at the front end near the head 22, has an external diameter A1 which is smaller than an external diameter A2 of the head 22. The shield 12 itself has a hollow cylindrical opening 32, with an opening diameter Ö which corresponds at most to the external diameter A1 of the central portion 24. In this way, on one hand, the shield 12 is mounted securely on the adapter 18 and, on the other hand, it is thus ensured that the front of the shield 12 bears against the abutment contour 30 and cannot slip off over the head 22.

The earpiece 14 in this case has a rotationally symmetrical configuration, in such a way that the abutment contour 30 is accordingly an annular surface extending about and oriented perpendicular to the longitudinal direction L.

Figure 3:
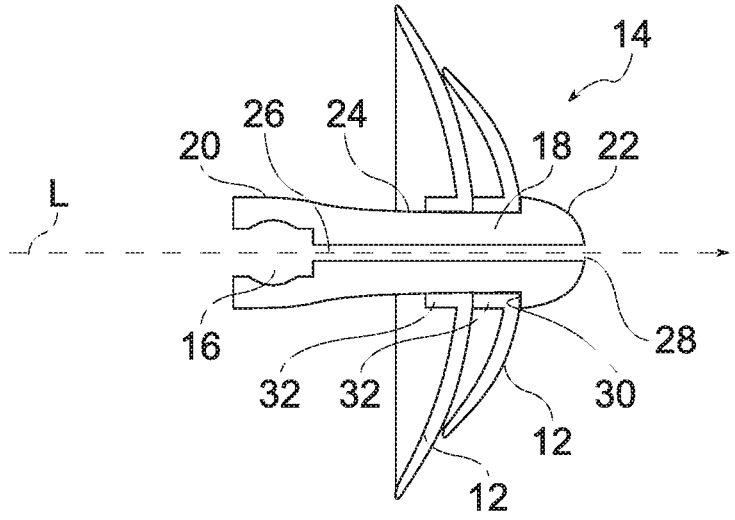
FIG. 3 is a longitudinal-sectional view of a variant of the earpiece.

In view of the modular concept, the shield 12 is exchangeable and can be removed again from the adapter 18 in order for another shield 12 to be fitted. Moreover, it is advantageously possible to fit a plurality of shields 12 onto the adapter 12 in order to adapt the overall earpiece 14 optimally to the individual requirements of a user. This is shown by way of example in FIG. 3. FIG. 3 shows only the earpiece 14, onto the adapter 18 of which two shields 12 are pushed in this case. The shields 12 are disposed directly one behind the other in the longitudinal direction L, i.e. the front shield 12, which bears against the abutment contour 30, itself forms an abutment contour for the subsequent shield 12.

Figure 4:
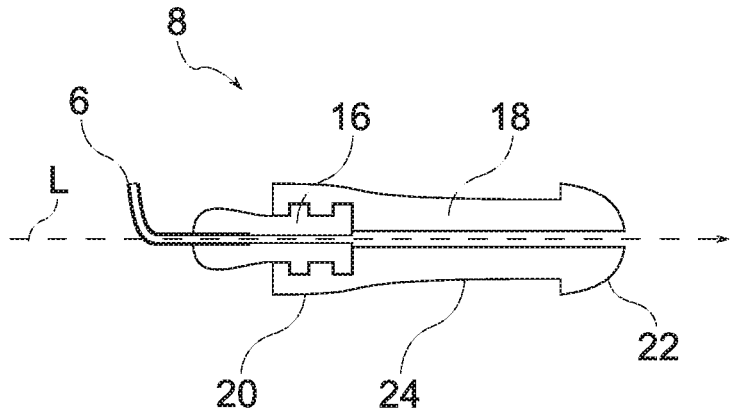
FIG. 4 is a longitudinal-sectional view of a further ear insert.

FIG. 4 shows an ear insert 8 for a hearing aid 2 in which the receiver 10 is accommodated in the housing 4. Accordingly, the attachment piece 16 in this case is only a connection part which is secured on the supply line 6, which in this case is accordingly a sound tube. The latter is in turn attached to a receiver 10 (not shown herein), in such a way that the attachment piece 16 as a whole is connected to the receiver 10. Moreover, the plug connection is not constructed in this case as a spherical plug connector as in FIG. 2, and instead the attachment piece 16 has a so-called "honey dipper" attachment, which is plugged into a complementary socket of the adapter 18.

The earpiece 14 shown in FIG. 4 is not yet fitted with shields 12. However, the shields can be easily pushed on over the front end of the head 22. In order to make this easier, the head 22 is rounded and tapers at the front. A shield 12 that is to be fitted in this case is expediently produced from an elastic material, in such a way that the opening 32, when pushed over the head 22, initially widens slightly and then draws back onto the central portion 24 in order to engage form-lockingly around the central portion.

The adapter 18 is approximately 4 mm to 12 mm long, of which the central portion 24 makes up about half and the head 22 and the end portion 20 each make up about a quarter. In order to accommodate the attachment part 16 securely in the adapter 18, the end portion 20 is thicker than the central portion 24, i.e. the end portion 20 has an external diameter A3, which is greater than the external diameter A1 of the central portion 24 and which in this case corresponds to the external diameter A1 of the head 22. The transition between the end portion 20 and the central portion 24 is continuous rather than stepped, i.e. the central portion 24 widens at the rear. The external diameter A2 of the head 22 is in particular between 2 and 5 mm.

The following is a summary list of reference numerals and the corresponding structure used in the above description of the invention. List of reference signs:

2 hearing aid
4 housing
6 supply line
8 ear insert
10 receiver
12 shield
14 earpiece
16 attachment part
18 adapter
20 end portion
22 head
24 central portion
26 sound channel
28 sound outlet opening
30 abutment contour
32 opening
A1 external diameter (of the central portion)
A2 external diameter (of the head)
A3 external diameter (of the end portion)
L longitudinal direction
Ö opening diameter

The invention claimed is:

1. A hearing aid or BTE hearing aid, comprising:

an ear insert having a receiver, an earpiece and an attachment part connected to said receiver;

said earpiece having a modular construction and including an elongate adapter being mounted on said attachment part and extending in a longitudinal direction;

said adapter including only one central portion and a head having a rear abutment contour, said head adjoining said central portion in said longitudinal direction, and said central portion being tapered relative to said head; and said earpiece having a plurality of shields configured to be exchangeably fitted onto said central portion with at least one of said shields bearing against said rear abutment contour, wherein said one shield bears directly against said rear abutment contour, and another of said shields bears against said one shield.

2. The hearing aid according to claim 1, wherein at least one of said shields is exchangeable and is chosen from a set of shields for individual adaptation to an auditory canal of a user.

3. The hearing aid according to claim 1, wherein at least one of said shields has an opening with an opening diameter corresponding at most to an external diameter of said central portion.

4. The hearing aid according to claim 1, wherein:

said adapter has an end portion secured on said attachment part; and said central portion defines a continuously formed transition between said head and said end portion without any additional rear abutment contour for said another of said shields.

5. The hearing aid according to claim 4, wherein:

said head has an external diameter; and said end portion has an external diameter and the external diameter of said end portion corresponds to the external diameter of said head.

6. The hearing aid according to claim 1, wherein said adapter is formed in one piece.

7. The hearing aid according to claim 1, wherein said adapter and at least one of said shields are formed of identical material.

8. The hearing aid according to claim 1, wherein said adapter is tubular and has a sound channel leading into a sound outlet opening in said head.

9. The hearing aid according to claim 1, wherein said head has an external diameter in a range of 2 mm to 5 mm.

10. The hearing aid according to claim 1, wherein said adapter is at least 4 mm long and at most 12 mm long.

11. The hearing aid according to claim 1, wherein said adapter is at least 4 mm long and at most 8 mm long.

12. The hearing aid according to claim 1, wherein said head has a rounded front end.

13. In a hearing aid according to claim 1, an earpiece having a modular construction, the earpiece comprising:

an elongate adapter constructed for connection to said attachment part of the hearing aid, said adapter extending in a longitudinal direction, and said adapter having a head with a rear abutment contour; and a plurality of shields, at least one of said shields being exchangeably fitted onto said adapter and at least one of said shields bearing against said rear abutment contour.

14. The hearing aid according to claim 1, wherein:

said shields each have a central part and a radial shield part;

said central part extends in the longitudinal direction from a first end to a second end, and said radial shield part is formed at said second end; and said shields abut each other at said central parts.

15. The hearing aid according to claim 1, wherein said another shield has a larger diameter than said one shield which bears directly against said rear abutment contour.

16. The hearing aid according to claim 15, wherein said radial part of said shield which bears directly against said abutment contour has a radial outermost part which touches said radial part of said another shield with the larger diameter only at said radial outermost part.

17. The hearing aid according to claim 1, wherein:

said adapter has an end portion secured on said attachment part;

said central portion defines a continuously formed transition between said head and said end portion without any additional rear abutment contour for said another of said shields; and said shields each have a central part and a radial shield part, said central part extending in the longitudinal direction from a first end to a second end, said radial shield part is formed at said second end and said shields abut each other at said central parts.

* * * * *